US005431080A

United States Patent [19]

Wiesenthal

[11] Patent Number: 5,431,080

[45] Date of Patent: Jul. 11, 1995

[54] CONTINUOUSLY ADJUSTABLE CAPO FOR ONE HAND OPERATION

[76] Inventor: John F. Wiesenthal, 157 Kimbark Rd., Rochester, N.Y. 14610

[21] Appl. No.: 304,515

[22] Filed: Sep. 12, 1994

[51] Int. Cl.[6] ..... G10D 3/00

[52] U.S. Cl. ..... 84/318

[58] Field of Search ..... 84/318

[56] References Cited

U.S. PATENT DOCUMENTS

| | | | |
|---|---|---|---|
| 4,149,443 | 4/1979 | Bringe | 84/318 |
| 4,168,648 | 9/1979 | Ronca | 84/318 |
| 4,270,432 | 6/1981 | Wilkerson | 84/318 |
| 4,324,165 | 4/1982 | Wilkerson | 84/318 |

*Primary Examiner*—Michael L. Gellner
*Assistant Examiner*—Patrick J. Stanzione
*Attorney, Agent, or Firm*—Mark A. Bobb

[57] ABSTRACT

A transposition device that can be applied with one hand to the neck of a string instrument provides continuously adjustable pressure to adjust the musical sound of a string and includes a frame with a yoke and a first arm extending from one end of the yoke. A movable second arm is attached to the opposite end of the yoke by a first pivot. The second arm includes a cam follower and a compliant material on an inner surface. A cam movably attached to the frame by a second pivot contacts the cam follower of the second arm. When the cam moves from a first position to a second position, the second arm moves from a disengaged position to an engaged position that presses a string of a string instrument with a continuously adjustable pressure. The user selects the pressure desired while the capo is being installed on the neck of the string instrument. The cam may be exposed or it may be enclosed by a portion of the frame.

16 Claims, 8 Drawing Sheets

CONTINUOUSLY ADJUSTABLE CAPO FOR ONE HAND OPERATION

BACKGROUND OF THE INVENTION

1. Field of Invention

This invention relates to a tuning device used to change the key of a string instrument having a neck over which extends one or more strings.

2. Description of Related Art

A capo, also known as a capo tasto or capodastro, is a device that is applied to the neck of a stringed instrument such as a guitar, banjo, mandolin, bass, ukelele and the like to depress the strings of the instrument and. thereby shorten the effective vibrating length of the strings to alter their sound.

Applying a capo to a stringed instrument commonly requires the use of both hands. This is often an awkward process requiring moving the instrument or the performer's hands or both from a playing position to another position for the installation or removal of the capo, after which the playing position must be resumed. This process can be distracting to both the performer and the audience. Therefore it is desirable to have a capo which can be easily installed and removed with a minimum of instrument or performer movement.

When a capo is applied to a string instrument, the capo depresses a string against a fret resulting in a change in string tension and variation in intonation. It is desirable to apply only the minimum pressure necessary to secure contact of the string with the fret for the capo to work most effectively. Excess pressure increases intonation loss and distortion. A capo which can apply a continuously variable amount of pressure would allow the performer to minimize intonation loss and distortion.

Typically, capos which provide pressure adjustment must be preset before use on a stringed instrument. For example, the capo described by Wilkerson in U.S. Pat. No. 4,270,432 uses a toggle mechanism and an eccentric cam for a pivot to clamp the capo to the neck of a stringed instrument. The user must adjust the cam prior to placing the capo on the instrument's neck. The pressure applied by the toggle mechanism reaches a maximum when the toggle passes a top dead-center position, after which the applied pressure is reduced. The user must also balance the amount of pressure desired when the capo is installed with the amount of pressure necessary to move the toggle mechanism past the top dead-center position. In a related example, the capo in Wilkerson's U.S. Pat. No. 4,324,165 requires the user to first adjust a screw prior to placing the capo on the instrument. In operation, a lever moves a roller bearing pivot from a first recess to a second recess. The motion of the bearing pivot presses a lower arm against the neck of the instrument, providing the clamping action. Again, the user must preset a pressure adjustment prior to installing the capo, and the selected pressure is a compromise between the pressure desired when installed and the pressure needed to move the bearing pivot from the first to the second recess.

Another problem with traditional capos is their inability to adjust the amount of pressure applied while the capo is being installed by the user. It would be preferable if pressure adjustment were continuous so the user could adapt the capo's operation to changing environment or performance needs. Both Wilkerson '432 and Wilkerson '165 must be adjusted prior to installation and are not easily adjusted during installation. Ronca U.S. Pat. No. 4,168,648 provides a capo with a clamping lever having an apex or cam. The apex must pass over a pivot axis where maximum pressure is applied before reaching a stable clamping position where a lesser pressure is applied to the neck of the instrument. No pressure adjustment is available Ronca '648.

Traditional Capos are designed to depress all of the strings of a string instrument. A capo which allows a performer to depress a subset of all strings would increase the harmonic variety available to the performer by creating pedal tones or drones.

A capo is therefore desired which can be installed and removed with a minimum of instrument or performer movement. Operation with one hand is advantageous. The capo should also continuously variable pressure which can be selected by the user while the capo is being installed.

SUMMARY OF THE INVENTION

The present invention provides a capo which can easily be applied to the neck of a stringed instrument with one hand. In addition, the capo can be removed from the instrument with one hand.

The capo of the present invention can apply to strings a continuously variable amount of pressure which can be determined by the user while the capo is being applied to the neck of a string instrument.

The capo of the present invention can further be applied to all of the strings, or to a subset of all strings of a string instrument.

One embodiment of a capo for a string instrument having a neck over which extends a string comprises a substantially L-shaped frame having a yoke and a first arm extending from a first end of the yoke; a second arm movably attached to a second end of the yoke at a first pivot; and a cam movably attached to the yoke at a second pivot, whereby as the cam moves from a first position to a second position, the second arm moves from a disengaged position to an engaged position that presses a string against the neck of a string instrument; and whereby as the cam moves from a second position to a first position, the cam follower follows a portion of the cam surface and the string urges the second arm from an engaged position that presses a string against the neck of a string instrument to a disengaged position.

Another embodiment of a capo for a string instrument having a neck over which extends a string comprises first and second frame sides wherein each frame side includes a yoke portion, a first arm portion, and a first and second recess; a first arm extension located between the first arm portions of the frame sides to provide a first arm; a second arm movably attached between the first and second frame sides by attachment means; and a cam movably attached between the first and second frame sides by attachment means such that a portion of the second arm can contact the cam; whereby as the cam moves from a first position to a second position, the cam surface causes the second arm to move from a disengaged position to an engaged position that presses a string against the neck of a string instrument; and whereby as the cam moves from a second position to a first position, the cam follower follows a portion of the cam surface and the string urges the second arm from an engaged position that presses a string against the neck of a string instrument to a disengaged position.

DESCRIPTION OF PREFERRED EMBODIMENT

The present invention is a capo that can be placed about the neck of a stringed instrument to depress a string, thereby shortening the effective vibrating length of the string to alter the string's sound.

Figure 1:
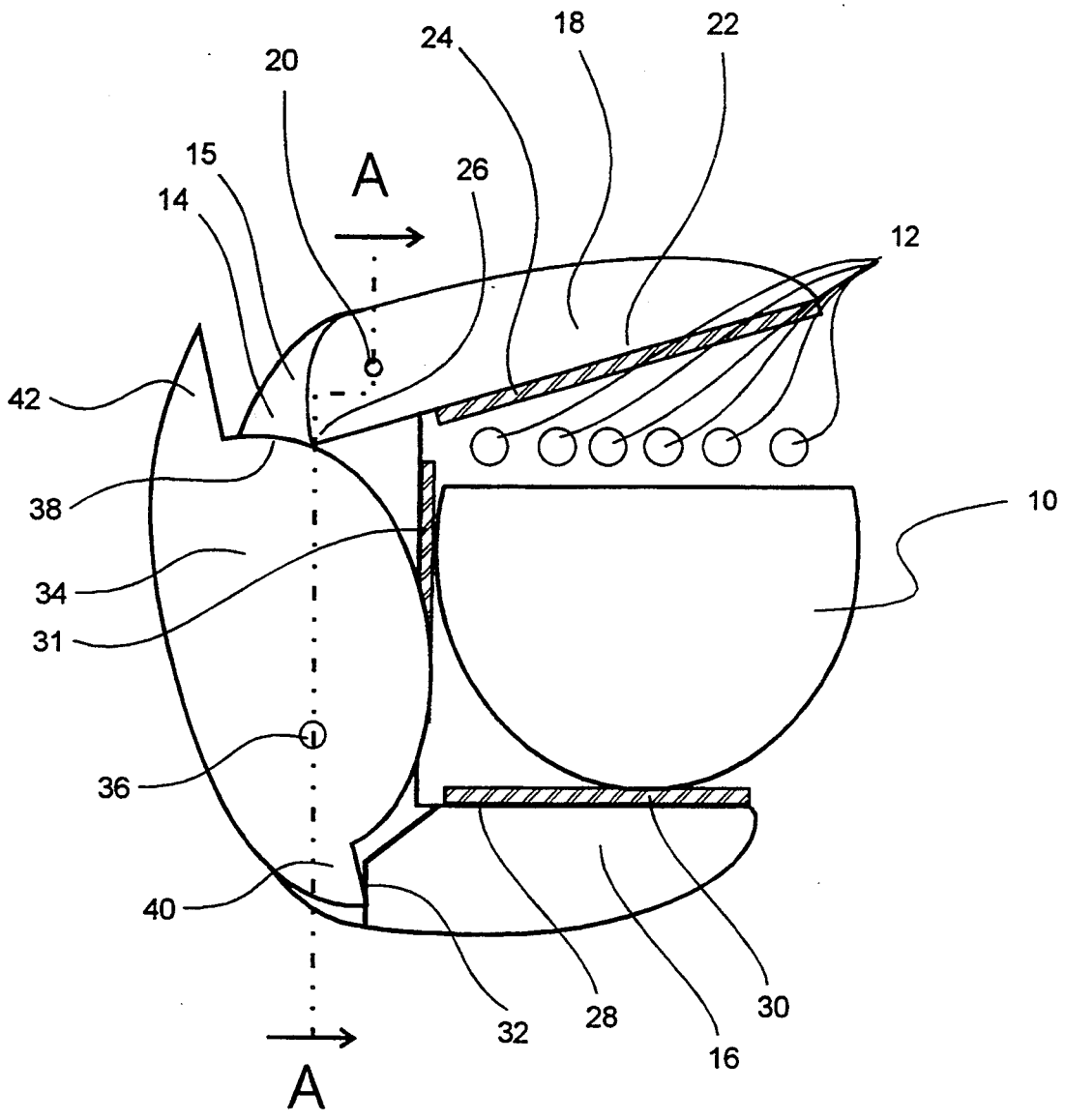
FIG. 1 is a plan view of one embodiment of the present invention in a disengaged position around the neck of a string instrument, where a portion of a first arm serves as a stop for a cam.
Figure 2:
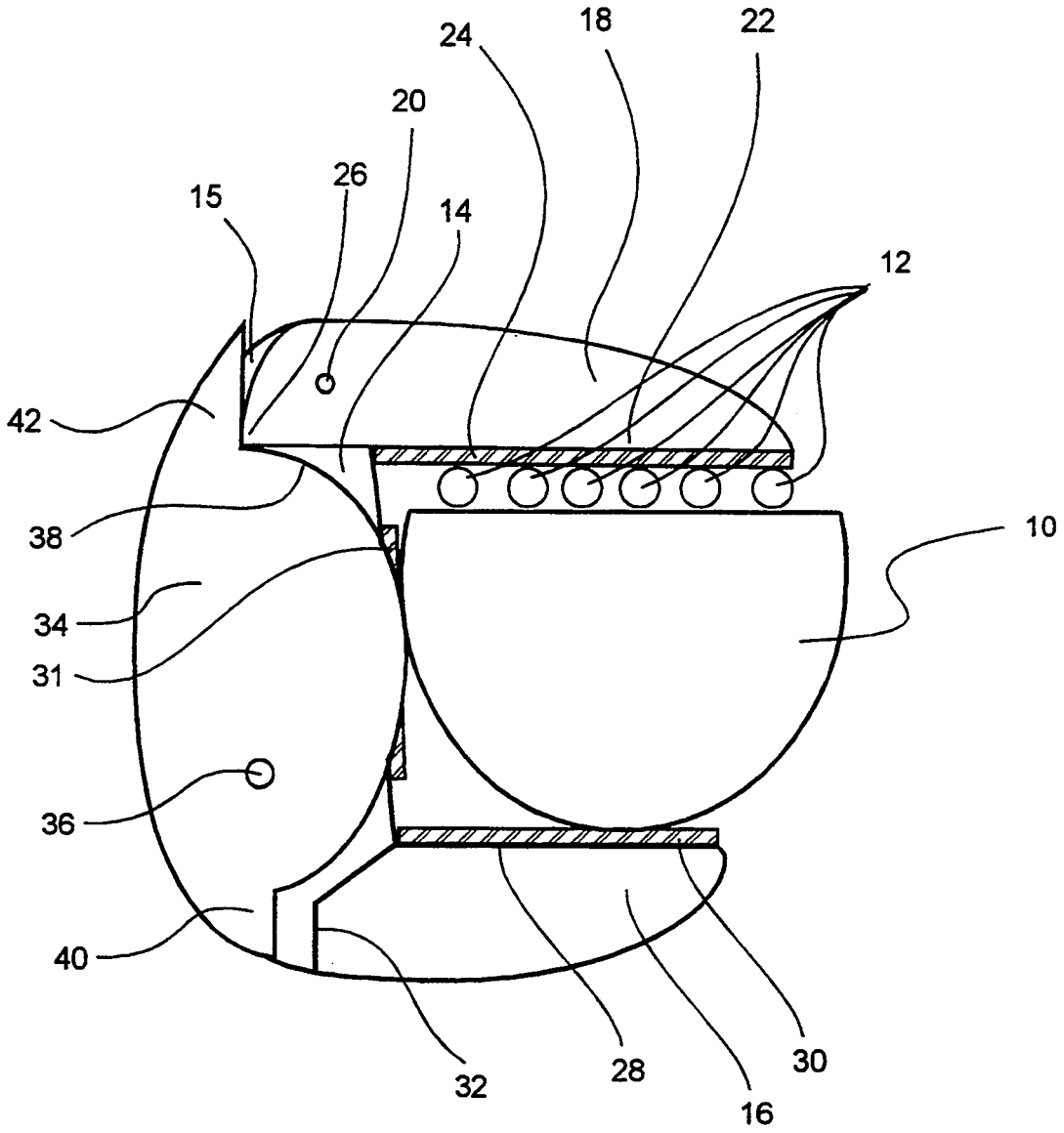
FIG. 2 shows the embodiment of FIG. 1 in an engaged position.
Figure 3:
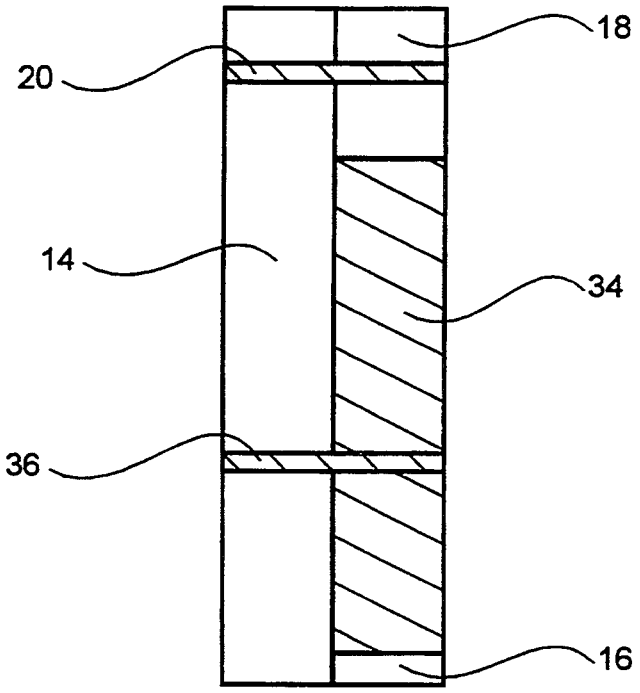
FIG. 3 shows a cross section view along section line A—A of FIG. 1, showing one embodiment of how the second arm and cam may be attached to the frame.

An embodiment of the instant invention is shown in FIGS. 1–3. The neck of a string instrument 10 often has a rounded back surface and a substantially flat surface above which one or more strings 12 are stretched. A substantially U-shaped capo has an L-shaped frame 14 which includes a yoke 15 and a first arm 16 extending from one end of yoke 15. A movable second arm 18, attached to frame 14 at the other end of yoke 15 by a second arm pivot 20, can move between a disengaged position (FIG. 1) and an engaged position (FIG. 2). When the second arm is in the disengaged position, the capo can be placed about the neck of the instrument or removed with one hand.

The inner surface 22 of second arm 18 may be straight or it may be contoured to better contact strings of varying diameters or to follow the shape of the instrument's neck 10. Compliant material 24 attached to inner surface 22 of second arm 18 provides a resilient contact surface which presses against strings 12. Compliant material 24 may be adhered to inner surface 22 or it may be attached by other means known to those skilled in the art.

Second arm 18 also includes a cam follower 26 which may be a portion of second arm 18 as shown, or cam follower 26 may be an additional element such as a roller or pin or the like.

First arm 16 also includes an inner surface 28. Optional compliant material 30 may be attached to inner surface 28 and optional yoke compliant material 31 may be attached to yoke 15 in similar manner to the second arm compliant material 24. First arm compliant material 30 and yoke compliant material 31 prevent damage to neck 10 and provide non-slip surfaces which stabilize the capo. First arm 16 also includes a stop surface 32 which limits the movement of a cam 34.

Cam 34 is movably attached to yoke 15 by a cam pivot 36. Cam surface 38 of cam 34 contacts cam follower 26 of second arm 18. When cam 34 is in a first or disengaged position, first cam stop 40 engages stop surface 32 of first arm 16.

Placing the invention on the neck 10 of an instrument can be accomplished with one hand. While holding the capo, the user positions it around the instrument's neck and easily presses cam 34 with the palm or a finger to depress the strings 12. When the user presses cam 34 toward second arm 18, cam surface 38 presses against cam follower 26, causing second arm 18 to rotate toward strings 12. As the user continues to press cam 34, second arm compliant material 24 presses against strings 12, causing them to change their sound. The user may stop applying pressure to cam 34 at any point to achieve a desired minimum pressure which sufficiently clamps strings 12. Alternatively, the user may continue to press cam 34 until cam follower 26 engages second cam stop 42, effectively stopping further movement of cam 34 and second arm 18, and clamping the capo on the instrument's neck.

Removing the invention from the neck 10 of an instrument can also be accomplished with one hand. While grasping the capo positioned around the instrument's neck, the user easily pulls cam 34 or second cam stop 42 with a finger to release strings 12. When the user pulls cam 34 or second cam stop 42 away from second arm 18, cam surface 38 withdraws from cam follower 26. Tension in strings 12 urges second arm 18 away from neck 10, cam follower 26 remains in contact with cam surface 38 and second arm 18 rotates away from strings 12. As the user continues to pull cam 34, second arm compliant material 24 releases strings 12, changing the pressure on them. The user continues to pull cam 34 until first cam stop 40 engages stop surface 32, effectively stopping further movement of cam 34 and second arm 18. The capo can now be removed from neck 10 of instrument with the same hand that disengaged the capo.

FIG. 3 shows a cross section view along section line A—A of FIG. 1, detailing one method of movably attaching second arm 18 and cam 34 to frame 14. In this example, pivot pin 20 movably attaches second arm 18 to frame 14 and cam 34 is movably attached to frame 14 by pivot pin 36. Alternative methods for attaching these components to frame 14 include rivets, screws, molded bosses and other methods well known to those skilled in the art.

Figure 4:
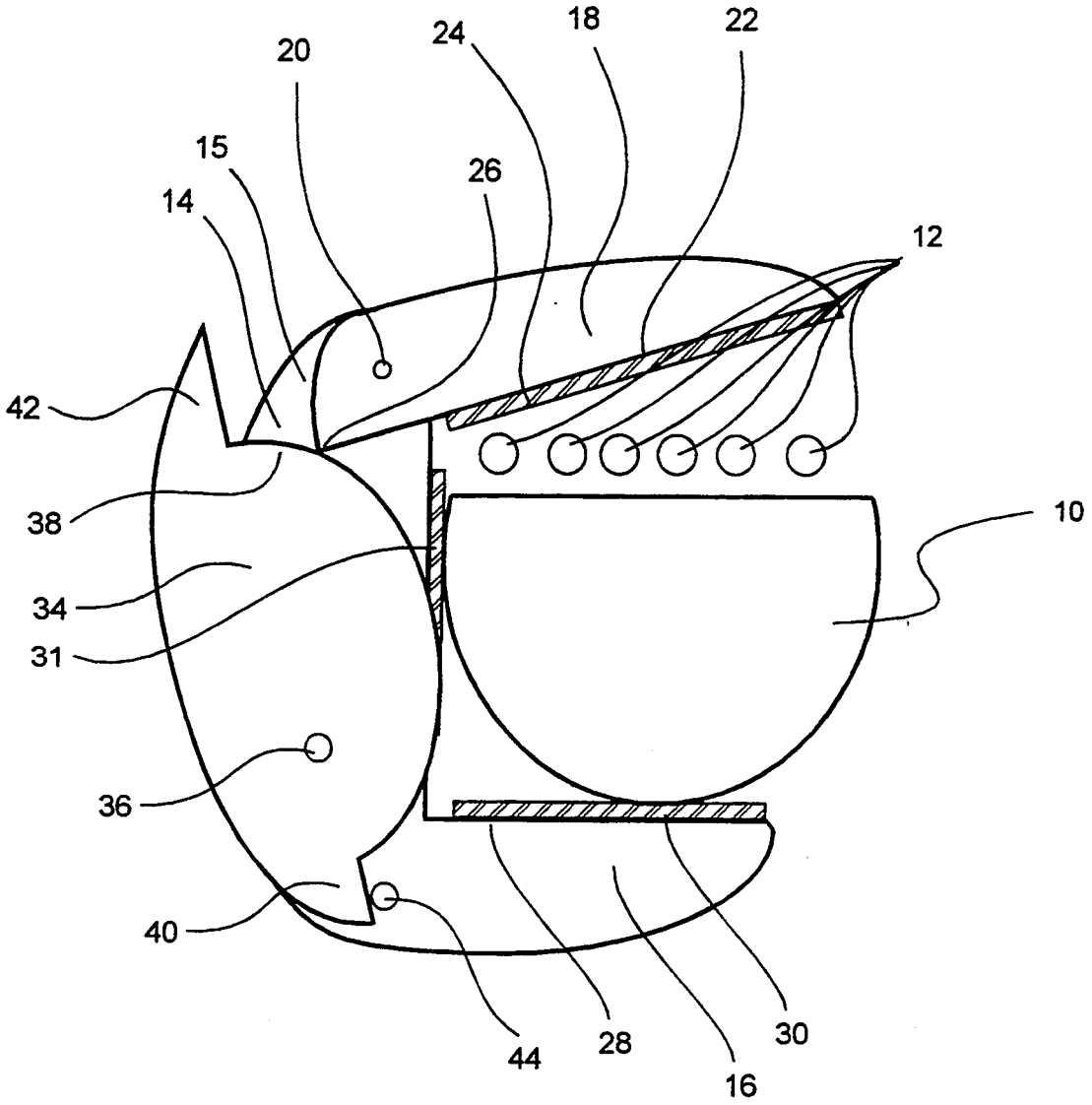
FIG. 4 is a plan view of another embodiment of the present invention in a disengaged position around the neck of a string instrument, where a pin on the first arm serves as a stop for a cam.

FIG. 4 shows an alternative embodiment of the invention in FIG. 1 where stop surface 32 is replaced by cam stop pin 44. Cam stop pin 44 engages first cam stop 40 when cam 34 is in a first or disengaged position.

Figure 5:
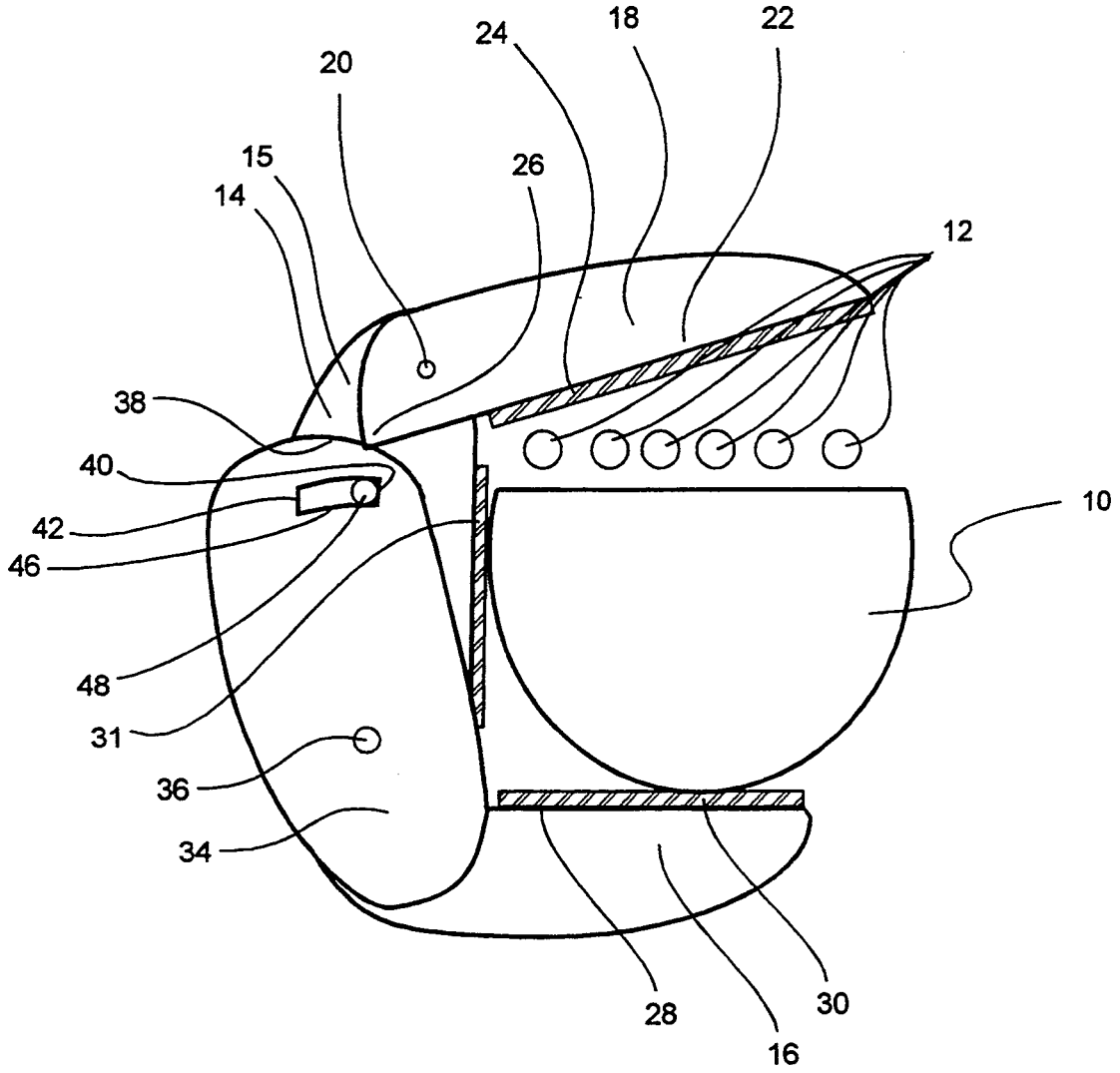
FIG. 5 is a plan view of another embodiment of the present invention in a disengaged position around the neck of a string instrument, where a pin on the frame serves as a stop for a cam.

FIG. 5 shows yet another alternative embodiment of the invention in FIG. 1. In this alternative, cam 34 includes a guide channel 46 and a guide pin 48 attached to frame 14 and located within guide channel 46. The ends of guide channel 46 provide first cam stop 40 and second cam stop 42. When cam 34 is in a first or disengaged position, guide pin 48 is located against first cam stop 40 at one end of guide channel 46. As cam 34 is moved from the first position to the second or engaged position, guide channel 46 moves around guide pin 48 and s second arm 18 moves toward strings 12 as described previously. Again, the user may stop applying pressure to cam 34 at any point to achieve a desired pressure, or the user may continue to press cam 34 until second cam stop 42 engages guide pin 48, effectively stopping further movement of cam 34 and second arm 18.

Figure 6:
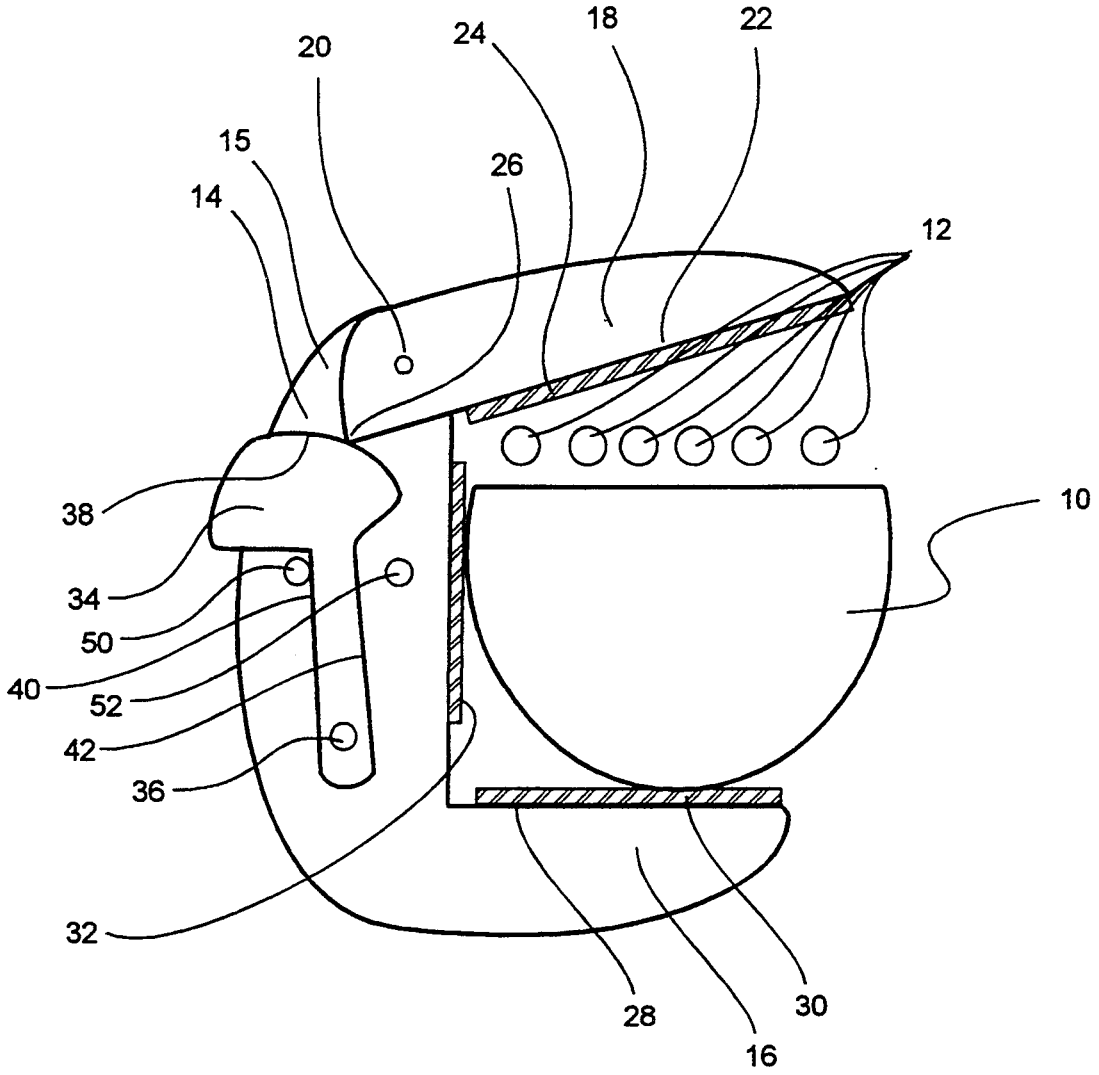
FIG. 6 is a plan view of another embodiment of the present invention in a disengaged position around the neck of a string instrument, where more than one pin on the frame serve as stops for a cam.

FIG. 6 shows another alternative embodiment of the invention in FIG. 1. Cam 34 in this case is a T-shaped member that moves between first cam stop pin 50 and second cam stop pin 52. When cam 34 is in a first or disengaged position, first cam stop 40 is located against first cam stop pin 50. As cam 34 is moved from the first position to the second or engaged position, second arm 18 moves toward strings 12 as described previously. The user may selectively stop applying pressure to cam 34 to achieve a desired pressure, or the user may continue to press cam 34 until second cam stop 42 engages second cam stop pin 52, effectively stopping further movement of cam 34 and second arm 18.

While these examples portray pins, channels and recesses in particular locations or components of the capo, it is recognized that one skilled in the art could easily reverse or modify the location of these elements and remain within the scope of this invention.

Figure 7:
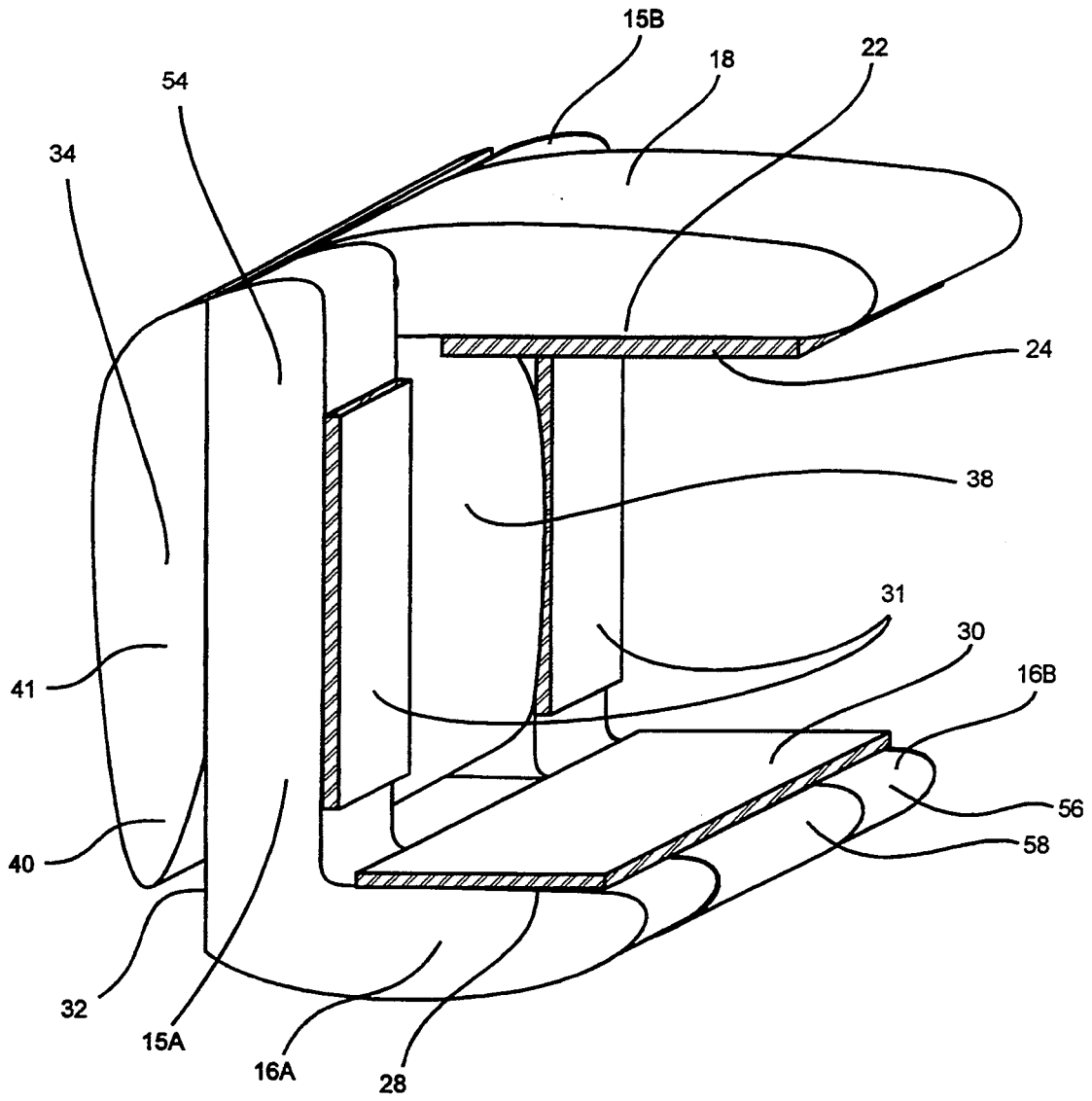
FIG. 7 is a three dimensional view of another embodiment of the present invention in an engaged position, where an enclosed cam pivots between two unmoving sides of the frame.
Figure 8:
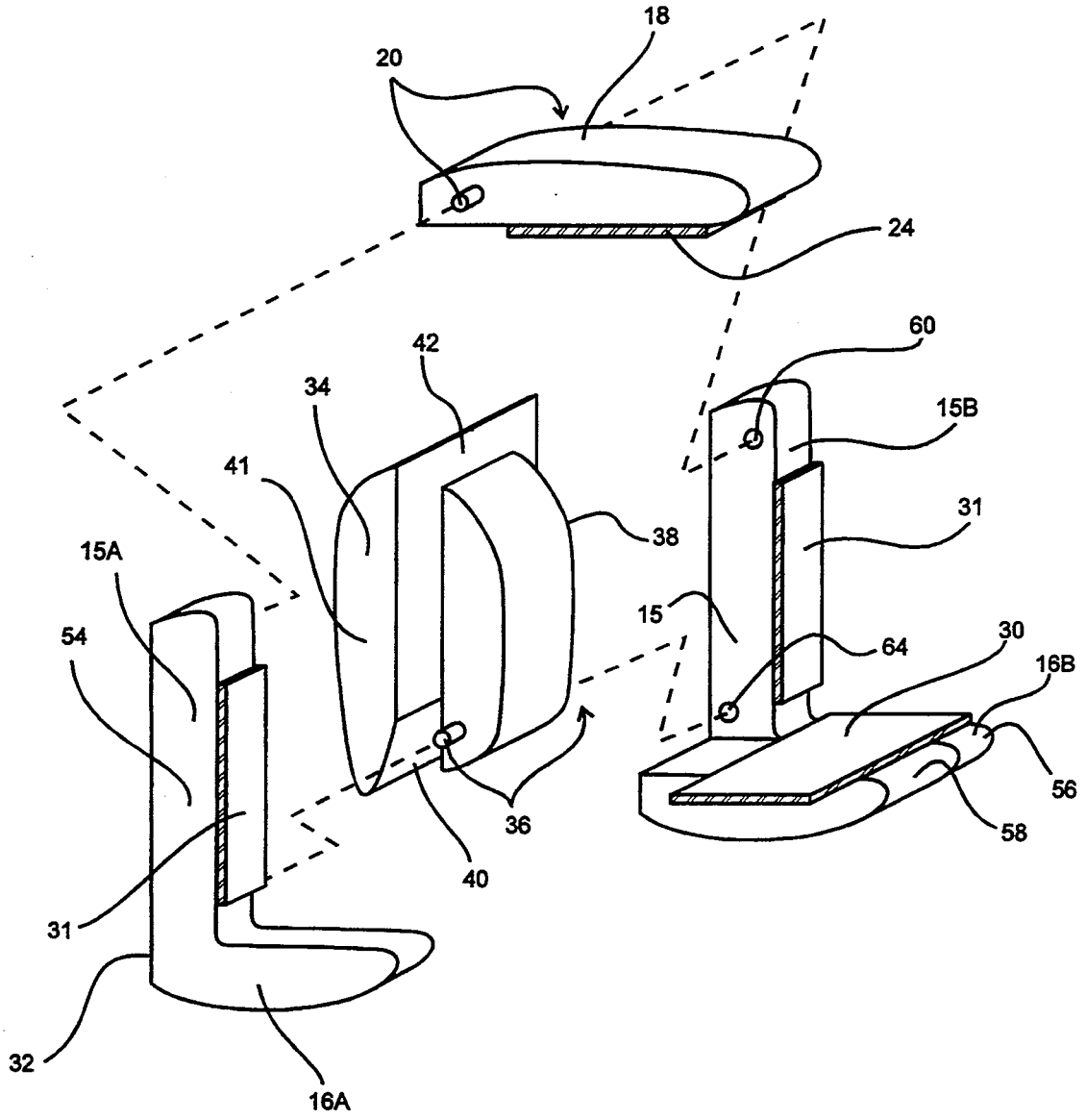
FIG. 8 shows an exploded three dimensional view of the embodiment in FIG. 7, showing how second arm pivots and cam pivots are held by cavities in the frame sides.

Another embodiment of the present invention includes an enclosed cam, as shown in FIGS. 7 and 8. A substantially U-shaped capo has first and s second L-shaped frame sides, 54 and 56 respectively. First frame side 54 includes a yoke portion 15A and a first arm portion 16A extending from one end of yoke 15A, and second frame side 56 includes a yoke portion 15B and a first arm portion 16B extending from one end of yoke 15B. A first arm extension 58 is located between first arm portion 16A and first arm portion 16B so that when these components are assembled, they form a first arm. Although first arm extension 58 is shown in FIG. 7 as a separate component, it is possible for first arm extension 58 to be a portion of either first frame side 54 or second frame side 56. Alternatively, a portion of first arm extension 58 could be attached to each of frame sides 54, 56. In another implementation, a single component could be manufactured which includes first frame side 54, second frame side 56 and first arm extension 58.

A movable second arm 18 includes a pair of second arm pivots 20, so that second arm 18 can move between a disengaged position and an engaged position. When the second arm is in the disengaged position, the capo can be applied to the neck of the instrument or removed with one hand.

The inner surface 22 of second arm 18 may be straight or it may be contoured. Compliant material 24 attached to inner surface 22 of second arm 18 may be adhered to inner surface 22. Second arm 18 includes a cam follower 26 which may be a portion of second arm 18 as shown, or cam follower 26 may be an additional element.

Second arm 18 is located between yoke portions 15A, 16A of first and second frame sides, 54 and 56 respectively, where each of the second arm pivot pins 20 engages a second arm pivot pin recess 60 located in yoke portions 15A and 16A. Second arm 18 may alternatively have conical, cylindrical or spherical projections in place of second arm pivot pins 20, where the projections engage the second arm pivot pin recesses 60.

First arm portions 16A, 16B and first arm extension 58 combined provide a first arm that includes an inner surface 28. Optional compliant material 30 may be attached to inner surface 28 and optional yoke compliant material 31 may be attached to yoke portions 15A, 15B. First arm compliant material 30 and yoke compliant material 31 prevent damage to neck (not shown). First arm portions 16A, 16B also include a stop surface 32 which limits the movement of a cam 34.

Cam 34 is movably located between yoke portions 15A and 16A of first and second frame sides 54 and 56 by a pair of cam pivots 36. Cam surface 38 of cam 34 contacts cam follower 26 of second arm 18. When cam 34 is in a first or disengaged position, first cam stop 40 engages stop surfaces 32 of first arm portions 16A and 16B. In the example shown in FIGS. 7 and 8, cam 34 may include a grip 41 which is an enlarged portion of cam 34. Grip 41 makes it easier for the user to move cam 34 to a desired position.

Placing the invention on the neck (not shown) of an instrument can be accomplished with one hand. While holding the capo, the user positions it around the instrument's neck and easily presses grip 41 of cam 34 with the palm or a finger to depress the strings 12. When the user presses grip 41 toward second arm 18, cam surface 38 presses against cam follower 26, causing second arm 18 to rotate toward strings 12. As the user continues to press grip 41, second arm compliant material 24 presses against strings 12, causing them to change their sound. The user may stop applying pressure to grip 41 at any point to achieve a desired pressure. Alternatively, the user may continue to press cam 34 until cam follower 26 engages second cam stop 42, effectively stopping further movement of grip 41, cam 34 and second arm 18.

Removing the invention from the neck (not shown) of an instrument can also be accomplished with one hand. While grasping the capo positioned around the instrument's neck, the user easily pulls grip 41 of cam 34 with one or two fingers to release strings 12. When the user pulls grip 41 away from second arm 18, cam surface 38 withdraws from cam follower 26. Tension in strings 12 urges second arm 18 away from neck (not shown), cam follower 26 remains in contact with cam surface 38 and second arm 18 rotate away from strings 12. As the user continues to pull grip 41, second arm compliant material 24 releases strings 12, changing the pressure on them. The user continues to pull grip 41 until first cam stop 40 engages stop surfaces 32, effectively stopping further movement of grip 41, cam 34 and second arm 18. The capo can now be removed from neck (not shown) of instrument with the same hand that disengaged the capo.

It is to be understood that the specific designs described as exemplary embodiments are merely illustrative of the spirit and scope of the invention. Modifications can be made in the specific designs consistent with the principles of the invention. For example, a capo could be provided without second arm compliant material 24.

The invention has been described in detail with particular reference to certain preferred embodiments thereof, but it will be understood that variations and modifications can be effected within the spirit and scope of the invention.

PARTS LIST

10 neck of string instrument
12 strings
14 frame
15 yoke
16 first arm
18 second arm
20 second arm pivot

22 second arm firmer surface
24 second arm compliant material
26 cam surface follower
28 first arm inner surface
30 first arm compliant material
31 yoke compliant material
32 stop surface
34 cam
36 cam pivot
38 cam surface
40 first cam stop
41 grip
42 second cam stop
44 cam stop pin
46 guide channel
48 guide pin
50 first cam stop pin
52 second cam stop pin
54 first frame side
56 second frame side
58 first arm extension
60 second arm pivot pin recess
64 cam pivot pin recess

What is claimed is:

1. A capo for one hand installation or removal from a string instrument having a neck over which extends a string, comprising:

a substantially L-shaped frame having a yoke and a first arm extending from a first end of said yoke;

a second arm movably attached to a second end of said yoke at a first pivot; and a cam movably attached to said yoke at a second pivot, whereby as said cam moves from a first position to a second position, said second arm moves from a disengaged position to an engaged position that presses with a continuously adjustable pressure a string of a string instrument.

2. The capo of claim 1 wherein said frame includes cam stop means which stops said cam in said first or said second position.

3. The capo of claim 2 wherein said cam stop means includes a surface located on said frame.

4. The capo of claim 2 wherein said cam stop means includes a stop pin located on said frame near said first end of said yoke.

5. The capo of claim 2 wherein said cam stop means includes a stop pin located on said frame between said first pivot and said second pivot.

6. The capo of claim 1 further including compliant material attached to said second arm to provide resilient contact with a string.

7. A capo for one hand installation or removal from a string instrument having a neck over which extends a string, comprising:

a substantially L-shaped frame having a yoke and a first arm extending from a first end of said yoke;

a second arm movably attached to a second end of said yoke at a first pivot, said second arm including a cam follower; and a cam including a cam surface, said cam being movably attached to said yoke at a second pivot such that said cam follower can follow a portion of said cam surface;

whereby as said cam moves from a second position to a first position, said cam follower follows a portion of said cam surface and said string urges said second arm from an engaged position, where said second arm presses a string of a string instrument, to a disengaged position.

8. A capo for one hand installation or removal from a string instrument having a neck over which extends a string, comprising:

first and second frame sides wherein each frame side includes a yoke portion, a first arm portion, a first and second recess;

a first arm extension located between said first arm portions of said frame sides to provide a first arm;

a second arm movably attached between said first and second frame sides by attachment means; and a cam movably attached between said first and second frame sides by attachment means such that a portion of said second arm can contact said cam;

whereby as said cam moves from a first position to a second position, said cam surface causes said second arm to move from a disengaged position to an engaged position that presses with a continuously adjustable pressure a string of a string instrument.

9. The capo of claim 8 wherein said second arm further includes compliant material to provide resilient contact with a string.

10. The capo of claim 8 wherein said attachment means includes a pivot pin which engages a recess.

11. The capo of claim 8 wherein said attachment means includes a protrusion which engages a recess.

12. The capo of claim 8 wherein a frame side includes a cam stop means which stops said cam in said first or said second position.

13. The capo of claim 12 wherein said cam stop means includes a surface located on said frame side.

14. The capo of claim 12 wherein said cam stop means includes a stop pin located between said attachment means of said cam and said attachment means of said second arm.

15. A capo for one hand installation or removal from a string instrument having a neck over which extends a string, comprising:

first and second frame sides wherein each frame side includes a yoke portion, a first arm portion, a first and second recess;

a first arm extension located between said first arm portions of said s frame sides to provide a first arm;

a second arm movably located between said first and second frame sides, said second arm including a first pair of pivots which movably engage said first recess of each frame side and said second arm further including a cam follower; and a cam including a cam surface, said cam being movably attached between said first and second frame sides by attachment means such that said cam follower can follow a portion of said cam surface, and further wherein said cam attachment means includes a second pair of pivots which movably engage said second recess of each frame side;

whereby as said cam moves from a first position to a second position, said cam follower follows a portion of said cam surface to move said second arm from a disengaged position to an engaged position that presses with a continuously adjustable pressure a string of a string instrument.

16. A capo for one hand installation or removal from a string instrument having a neck over which extends a string, comprising:

first and second frame sides wherein each frame side includes a yoke portion, a first arm portion, a first and second recess;

a first arm extension located between said first arm portions of said frame sides to provide a first arm;

a second arm movably located between said first and second frame sides, said second arm including a first pair of pivots which movably engage said first recess of each frame side and said second arm further including a cam follower; and a cam including a cam surface, said cam being movably attached between said first and second frame sides by attachment means such that said cam follower can follow a portion of said cam surface, and further wherein said cam attachment means includes a second pair of pivots which movably engage said second recess of each frame side;

whereby as said cam moves from a second position to a first position, said cam follower follows a portion of said cam surface and said string urges said second arm from an engaged position, where said second arm presses a string of a string instrument, to a disengaged position.

* * * * *